United States Patent [19]

Imai et al.

[11] 4,019,847

[45] Apr. 26, 1977

[54] APPARATUS FOR FORMING A REFRACTORY LINING FOR A CONTAINER

[75] Inventors: Hiroyuki Imai; Hidenobu Itoi; Hiromu Shimizu, all of Himeji; Yukio Kuroda, Hyogo, all of Japan

[73] Assignee: Nippon Steel Corporation, Tokyo, Japan

[22] Filed: Sept. 19, 1975

[21] Appl. No.: 614,906

[30] Foreign Application Priority Data

Oct. 7, 1974 Japan ..... 49-114670

[52] U.S. Cl. ..... 425/421; 425/414; 425/457

[51] Int. Cl.[2] ..... B28B 1/10; B28B 7/00

[58] Field of Search ..... 425/410, 414, 421, 432, 425/457

[56] References Cited

UNITED STATES PATENTS

| | | | |
|---|---|---|---|
| 2,193,847 | 3/1940 | Strong | 425/432 X |
| 2,888,731 | 6/1959 | McElroy et al. | 425/421 |
| 3,217,356 | 11/1965 | Stutsman | 425/421 |
| 3,302,262 | 2/1967 | Chanlund | 425/421 |
| 3,334,390 | 8/1967 | Steiro | 425/414 X |
| 3,577,610 | 5/1971 | Margolin et al. | 425/432 X |

*Primary Examiner*—J. Howard Flint, Jr.
*Attorney, Agent, or Firm*—Toren, McGeady and Stanger

[57] ABSTRACT

An apparatus for lining a container comprising a vibration-pressing mold to be placed on a refractory mix charged in the container, the outer shell of the mold being composed of a metal plate, a vibration-transfer frame provided on the inside of the metal plate, a plurality of vibrators provided on the vibration-transfer frame, an anti-vibration member provided on the upper end of the mold, a supporting frame for supporting the mold with the antivibration member inserted therebetween, a weight placed on the supporting frame, and a guide member for maintaining the mold in a stabilized posture during its sink-down into the refractory mix.

10 Claims, 13 Drawing Figures

APPARATUS FOR FORMING A REFRACTORY LINING FOR A CONTAINER

BACKGROUND OF THE INVENTION

The present invention relates to an apparatus for forming powder and granular refractory lining materials on inside walls of a container to be lined (herein called simply as a container) using a vibration-pressing mold which is allowed to sink-down freely in a stabilized state.

The term "container" used herein means any container in which molten metal, such as molten pig iron and molten steel is contained or is made to flow, and specifically it means a tapping trough for molten pig iron or steel, a tundish for continuous casting, a ladle and a furnace or vessel for degasing. The term "powder and granular refractory materials used herein means any powder and granular refractory materials which have a controlled particle size, mixed, with water and binder usable for casting, ramming or spraying but they must have inherent or given thixotropic property.

The thixotropic property of refractory materials means the nature that when the refractory materials are given vibration they fluidizes as like slurry, and when the vibration is stopped they solidify, and this property can be developed by grain size distribution adjustment, control of water content, addition of peptizer etc.

As for a method for lining a powder and granular refractory mix having the thixotropic property onto the inside wall of a metallurgical container, a method has been proposed in which the formation is done under vibration and pressure using a forming mold. More specifically, a refractory mix is charged in the container and a forming mold having a weight on its top is placed on the mix and allowed to sink-down with vibration, thereby the refractory mix which is fluidized like slurry in the space between the container and the mold is vibrated upward to fill the space, and then the vibration is stopped and the mold is taken out from the container to finish the lining on the inside wall of the container.

As for the method for the lining formation, there has been known a repair method and a replacement method. According to the repair method a fresh refractory lining is applied on the surface of an old lining, and according to the replacement method the old lining is removed and a fresh refractory lining is formed.

Among the metallurgical container to be applied with refractory lining, there are non-movable containers, such as a fixed trough provided on the blast furnace casting floor, and movable containers, such as an exchangeable trough and a tundish. Therefore, it is desirable the refractory lining can be applied to various types of containers.

For actual practice of the vibration-pressing lining method, it is important that the mold can freely sink-down, and the thickness of the lining to be obtained is almost equal around the mold, or a desired thickness is obtained around the mold.

The present inventors have discovered that when a forming mold having a weight on its top is placed on the powder and granular refractory mix charged in the container and vibration is given to the mix, the mold is vibrated down into the refractory mix and sinks-down considerably before the refractory mix shows the thixotropic property. The depth or distance of sink-down of the mold at this time varies depending on the condition of the refractory mix charged in the container, and as the forming surface of the mold is curved as mentioned hereinafter the mold is not stable in its position so that there is a problem that the mold inclines.

Further, when a guide as disclosed in Japanese Pat. No. 48-17405 is used for guiding the mold, there is a problem that when the mold inclines and contacts the guide and the mold is restricted thereby in its sinking-down. In this case, if the mold is hammered on the portion contacting the guide, the mold is released, but the operation is hindered remarkably.

Therefore, the object of the present invention is to provide a lining apparatus which overcomes the above defects and meets with various requirements.

The present invention will be described in details referring the attached drawings.

DESCRIPTION OF PREFERRED EMBODIMENTS

Figure 1:
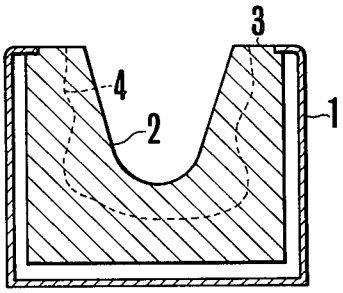
FIG. 1 shows a cross sectional view of a trough to which a refractory lining is applied.

In FIG. 1 which shows a cross section of a trough, a refractory lining 3 is formed on the whole inside wall of the trough frame 1 with a groove 2 in which molten pig flows. The lining 3 is eroded as shown the dotted line 4 by the flowing molten pig iron and molten slag. According to the present invention, the lining is formed including this eroded portion.

Figure 2:
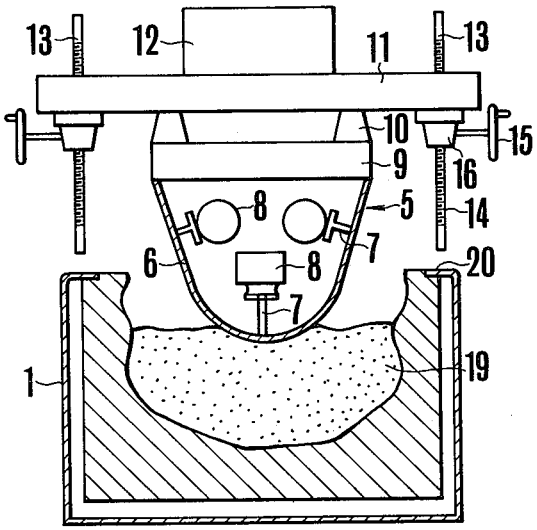
FIG. 2 shows one example of a vibration-pressing mold according to the present invention.

In FIG. 2 which shows one embodiment of the vibration-pressing mold according to the present invention, the mold 5 comprises a molding portion which acts as a vibrating plate, having a U shaped cross section and made of steel plate, for example a vibration transfer frame 7 arranged on the inside wall of the molding portion 6, and a plurality of vibrators 8 fixed on the vibration transfer frame 7.

On the top of the molding portion 6, a reinforcing member 9 is fixed, and a supporting frame 11 is provided on the reinforcing member with an anti-vibration member 10 therebetween.

The anti-vibration member 10 prevents loss of the vibration to be given to the refractory mix due to its transfer through the supporting frame to a guide member as mentioned hereinafter and other member, and at the same time prevents generation of vibration inpulsive tone from the portions of the apparatus which do not require vibration. A weight 12 is placed on the supporting frame 11.

The vibration-pressing mold 5 according to the present invention is constructed as above.

Figure 3A:
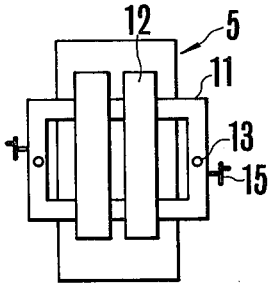
FIGS. 3(*a*) and (*b*) show respectively a supporting frame for supporting the mold, according to the present invention.
Figure 3B:
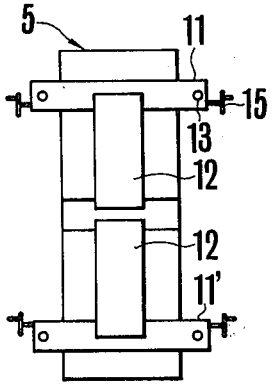

The arrangement of the supporting frame 11 may be modified as shown in FIG. 3(*a*) and FIG. 3(*b*), and in the modification shown in FIG. 3(*a*), the supporting frame 11 is placed at the center portion of the mold 5, and this type of arrangement is suitable for a mold having a relatively short length. In the modification shown in FIG. 3(*b*) two supporting frames 11 and 11' are arranged respectively near the end of the mold 5 having a relatively long length. In this case, the number of the supporting frame may be more than two.

Descriptions will be made herinunder on one embodiment of the present invention for vibration pressing forming of a lining on a non-movable container, such as a fixed trough, using a removable mold.

As stated hereinbefore, it is important that the mold 5 is stable in its posture while it sinks-down into the refractory, and the posture exerts a great influence on the time required for the lining formation and the properties of the lining, such as corrosion resistance and strength.

As shown in FIG. 2, the supporting frame is arranged projecting toward both sides of the mold 5. A support 13 is provided at both end portions of the frame 11, and the support 13 moves up and down through the frame 11. Around the outer surface of the support 13, a screw thread is formed, and the support 13 is moved up and down by the rotation of a handle 15 through a gear 16. For remote operation, the handle 15 may be replaced by a motor (not shown).

Figure 4A:
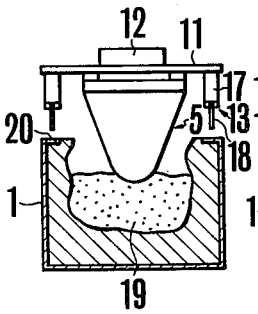
FIGS. 4(*a*) and (*b*) show, respectively, two additional embodiments according to the present invention.
Figure 4B:
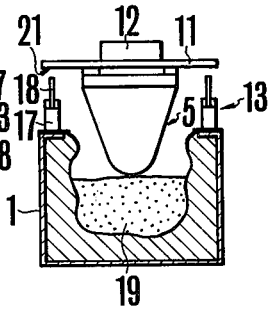

FIG. 4 shows a modification of the movable mold 5, and in FIG. 4(*a*) a plurality of expansible support 13 comprising a cylinder 17 driven by fluids such as compressed air and oil and a rod 18 are fixed on the lower side of the frame 11. In FIG. 4(*b*) the extensible support 13 comprising the cylinder 17 and the rod 18 is arranged in such a manner that the top end of the rod 18 can contact the lower side of the frame 11.

The mold 5 having the above structure is placed on the powder and granular refractory 19 in the trough frame 1 to be repaired as shown in FIG. 2.

Once the mold 5 is placed merely on the refractory 19 the mold 5 sinks-down to some degrees due to the weight 12, but it soon stops. Under this state, a space is provided so as to prevent the top end of the support 13 from contacting the upper end face 20. In FIG. 4(*b*), the space is provided between the top end of the rod 18 of the support 13 and the lower side of the support frame 11.

Figure 5:
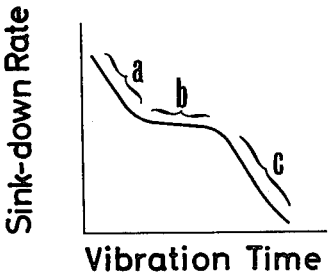
FIG. 5 shows a model curve for the sink-down rate of the mold under pressure and vibration.

According to the curve for the sink-down rate of the mold 5 under pressure and vibration shown in FIG. 5, the mold 5 sinks-down into the refractory due to vibration in the zone *a*, and in this zone the thixotropic property of the refractory 19 is not yet developed.

In the zone *b*, the thixotropic property is already developed from the refractory 19 close to the molding portion 6, but the fluidity of the refractory is only partial so that the sink-down rate of the mold 5 is low.

In the zone *c*, the thixotropic property prevails through the whole of the refractory 19, and the sink-down rate is decided by the relation between the weight of the mold 5 and the floating power given by the fluid refractory.

As described above, the sink-down rate of the mold 5 varies in each of the above zones and particularly in the zone *a*. The sink-down rate of the mold varies due to the change in the volume of the refractory mix during its vibration settlement so that the distance of the sink-down of the mold differs in the lengthwise direction of the mold 5. Furthermore the contact surface between the mold 5 and the refractory 19 is small and the cross sectional shape of the base portion of the mold being in the form of *a* U, the mold 5 is in an extremely unbalanced state. In the zone *a*, the space between the support 13 and the top of container should be preferably maintained relatively small, for example 50mm, by operating the handle 15. When the vibration of the mold 5 is continued, the mold 5 sinks-down in correspondence to the state of the refractory 19, and when the space as preliminarily set approaches zero, the handle is again operated to maintain the space to a predetermined value for example 50mm. By the above operation, the mold 5 continues to sink-down freely.

The operation for setting the space between the support 13 and the container is done by operating a plurality of handles 15 separately or similtaneously to a predetermined amount, and in a case where the space setting for the support 13 is done by a switch operation through a driving device, the space may be set to 30mm, for example, so as to effect the up-down movement (or extension and contraction) of the support 13 quickly.

As the value of the space between the lower end of the support 13 and the upper end face of the trough frame 1 decreases, the inclination of the mold in the lateral and/or longitudinal directions becomes smaller, so that a stable sink-down of the mold 5 can be attained.

As the zone *b*, develops to the zone *c*, the sink-down of the mold 5 progresses and the contact surface area between the mold 5 and the refractory 19 increases and the refractory 19 becomes more fluid and has almost uniform pressure distribution through the mix, so that the mold becomes better balanced and thus it is permitted to increase the space between the support 13 and the trough frame. For example, a space of 100mm can be set by one handle operation, thus resulting in a decreased number of the handle operations. Even in the zone *c*, if the space setting can be set quickly, for example, by a switch operation, the space may be set to 50mm.

In the above descriptions, the space setting system has been explained in which a prescribed space value is set first, and as the mold sinks-down and the space approaches zero or becomes zero, the prescribed space is again retained. However, if the sink-down rate of the mold is known from the factors such as the size of the mold 5, the weight of the weight 12, and the characteristics of the refractory 19, an automatic control system can be applied in which the movement of the support 13 is continuously effected in correspondence to the sink-down rate so as to maintain a constant space between the support and the container.

As described above, the mold 5 is allowed sink-down by its gravity by vibrating the mold with a space being maintained between the top end of the support 13 and the upper end face, and if the mold 5 inclines within a predetermined range of the space the support 13 on the sink-down side of the mold contacts the upper end face of the trough frame to prevent any further inclination of the mold, while the non-sink-down side of the mold sinks down due to continued vibration so that the mold 5 as a whole is balanced again. When the mold 5 retains its horizontal position (balanced state), a space is again set between the support 13 and the container and uniform and free sink-down of the mold is effected again.

In case of FIG. 4(*b*) also, space is set between the top end of the rod 18 of the support 13 and the lower side of the support frame 11 in a similar way as above, and the mold 5 is allowed to sink-down under vibration and pressure, and arc inclination of the mold, if caused, is compensated by adjusting the space to effect a uniform sink-down of the mold.

In the following descriptions, explanations will be made on one embodiment of the present invention for forming a lining on a movable metallurgical container such as an exchangeable trough and a tundish.

Figure 6:
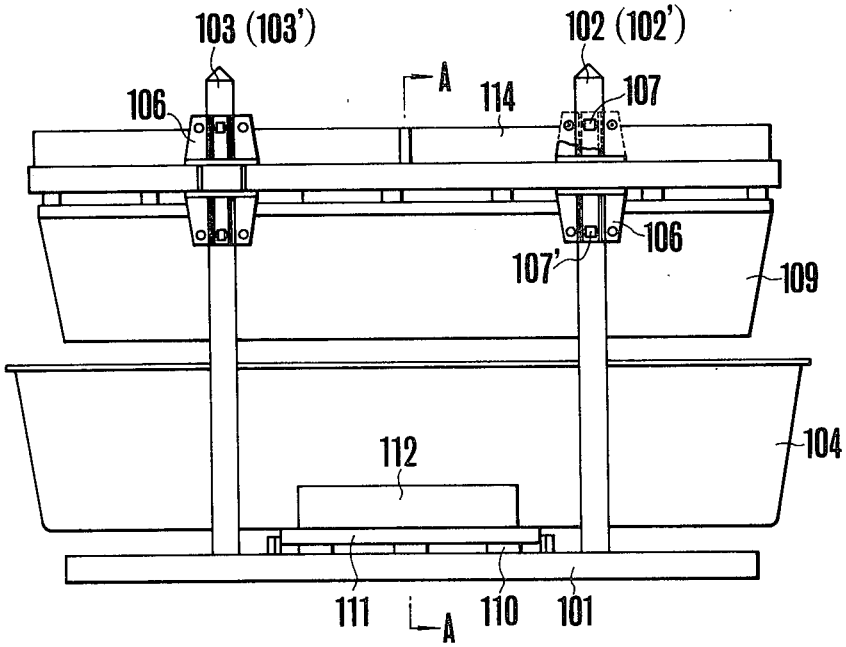
FIG. 6 shows a front view of the apparatus according to the present invention for lining an exchangeable trough.
Figure 7:
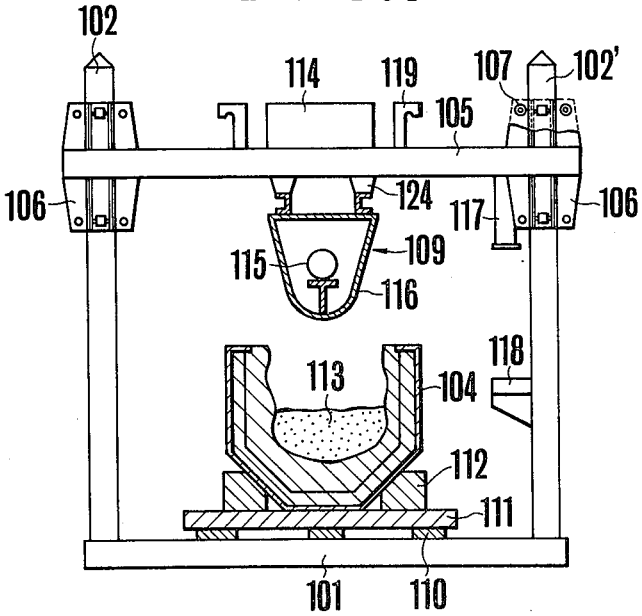
FIG. 7 shows a cross section of the apparatus shown in FIG. 6 along the line A—A.

In FIGS. 6 and 7, 101 represents a base frame on which four guide columns 102, 102', 103 and 103' stand upright fixedly. The space between the guide columns 102 and 102' is broader than the width of the trough 104, while the space between the guide columns 102 and 103 is determined depending on the length of the mold 109. A support frame 105 is arranged between the guide columns 102 and 102' and between the guide columns 103 and 103', or between the columns 102 and 103 and between the columns 102' and 103'.

At both ends of the support frame 105, a sliding member 106 extending vertically is provided. In FIGS. 6 and 7, this sliding member is shown to have a pair of rollers 107 and 107' arranged at its lower and upper portions with a predetermined space therebetween on all sides of the square guide column 102. If the column is a cylindrical column, the pair of rollers 107 and 107' are provided at three portions so as to surround the guide columns 102 (102') and 103 (103') in a circumferential direction.

The surface of the rollers 107, 107' is preferably covered with a rubber layer so as to prevent transfer of the vibration as mentioned hereinafter.

The space between the pair of rollers 107 and 107' assures that the support frame 105 moves down in a horizontal state between the guide columns 102 and 102'.

Figure 8:
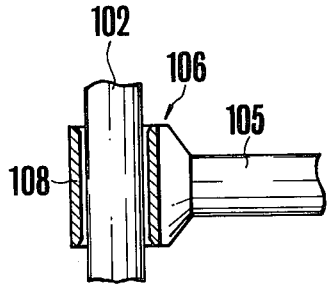
FIG. 8 shows a sliding member for sliding the mold on the supporting frame.

A modification of the sliding member 106 is shown in FIG. 8 in which the sliding member is a hollowed member 108 having an inside shape similar to the square or cylindrical guide column 102 but having a space therebetween enough to allow its sliding on the column. The hollowed member 108 has a length corresponding to the length of the support frame 105 so as to perform smooth up-down sliding of the support frame. The supporting frame 105 is provided with a hanger 119 and is suspended by a crane (not shown) by means of this hanger, and the supporting frame is slidably connected with the columns 102, 102', 103, 103' by means of the sliding member 106, 108 slidable on the columns.

The mold 109 in this embodiment is substantially same as the mold 5 shown in FIG. 2, and description will be omitted.

Just below the mold 109 maintained in a horizontal state during its up-down movement, a base 111 is placed on the base frame 101 with an anti-vibration member 110 therebetween and a trough 104 is placed on the base 111, 112 is a positioning member for placing the trough 104 in position at the time of lining formation.

A necessary amount of refractory mix 113 is put in the trough 104 placed in position and the supporting frame 105 is moved down to place the mold 109 on the refractory mix 113.

In a case when the total weight of the mold 109 and the supporting frame 105 is less than the required weight, a weight 114 is placed on the supporting frame 105.

Under this condition, when the vibrator 115 is actuated and vibration is transferred to the refractory mix 113 through the vibrating member (molding member) 116, the refractory mix 113 begins to develop the thixotropic property gradually to become fluid, while the mold 109 sinks-down by gravity in a horizontal position to proceed the lining formation.

The sink-down of the mold 109 is stopped when the stopper 117 provided on the support frame 105 contacts the stopper receiver 118 provided on the guide columns 102, 103.

When the lining formation of the refractory 113 is completed as above, the vibration is stopped. Then the refractory 113 solidifies due to its thixotropic property, and at this stage the supporting frame 105 is lifted up by the crane to disengage the supporting frame 105 with the guide column, and then the trough 104 is lifted up by the crane to transfer it to a drying yard where it is dried.

The lining apparatus shown in FIG. 6 and FIG. 7 utilizes an existing crane equipment for setting the mold 109 and the trough 104.

Figure 9:
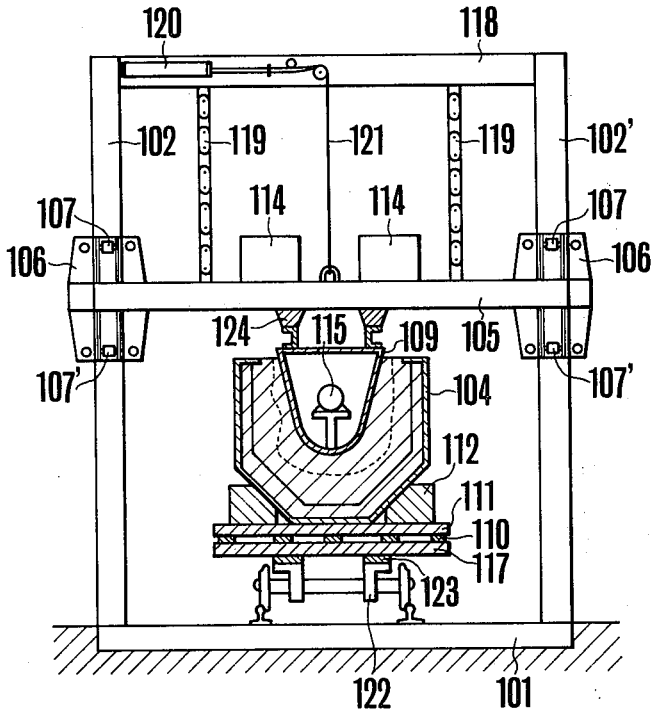
FIGS. 9 to 11 show respectively an embodiment of the apparatus according to the present invention for lining a movable metallurgical container.

FIG. 9 shows another modification of the apparatus according to the present invention, in which a lifting device for lifting the supporting frame 105 is used so as to lift the frame 105 without necessity of disengaging it with the guide columns 102, 102', 103 and 103', and the trough 104 is moved and transferred using a car 117. The top ends of the columns 102, 102', 103 and 103' are connected to the frame 118 to which a chain 119, for example, is connected, and the lower end of the chain 119 is connected to the supporting frame 105. The length of the chain represents the maximum depth of the sink-down of the mold 109 in the trough.

The supporting frame 105 can be lifted up by means of a wire 121 connected to the cylinder mechanism 120 actuated by fluid pressure and provided on the frame 118. This lifting mechanism for the supporting frame 105 may be performed by means of a separately provided drum (not shown) and a wire to be wound on the drum.

The trough placed just below the mold 109 is moved by means of the car 117. It is preferable that an anti-vibration member 123 is provided between the car 117 and the bearing 122 and that the anti-vibration member 110 is provided between the car 117 and the base 111. 124 is also an anti-vibration member provided between the hanger and the supporting frame.

Explanations will be made on the operation of the lining apparatus of the above structure.

First, the cylinder mechanism 120 is actuated to lift up the supporting frame 105 and then the car carrying the trough 104 is moved into place the trough 104 just below the mold 109.

A fresh refractory 113 has already been charged in the trough 104 at this time. Then the supporting frame 105 is moved down by releasing the lifting power of the cylinder mechanism 120 gradually to place the mold 109 on the refractory mix 113 in the trough, and the lifting power is wholly released.

Next, when the vibrator 115 is actuated, the refractory 113 begins to develop its thixotropic property and becomes fluid, while the mold 109 sinks-down by gravity in a horizontal position to proceed the lining formation. When the chain extends to its full length the mold 109 does not sink-down any further, as shown in FIG. 9. Upon completion of the lining formation, the vibrator is stopped and the cylinder mechanism 120 is actuated to lift up the supporting frame 105, thereby the mold is taken out. Then the car 117 is drawn out and moved to a drying yard where the trough is dried.

Next, explanations will be made on the apparatus according to the present invention for lining a movable container.

Figure 10:
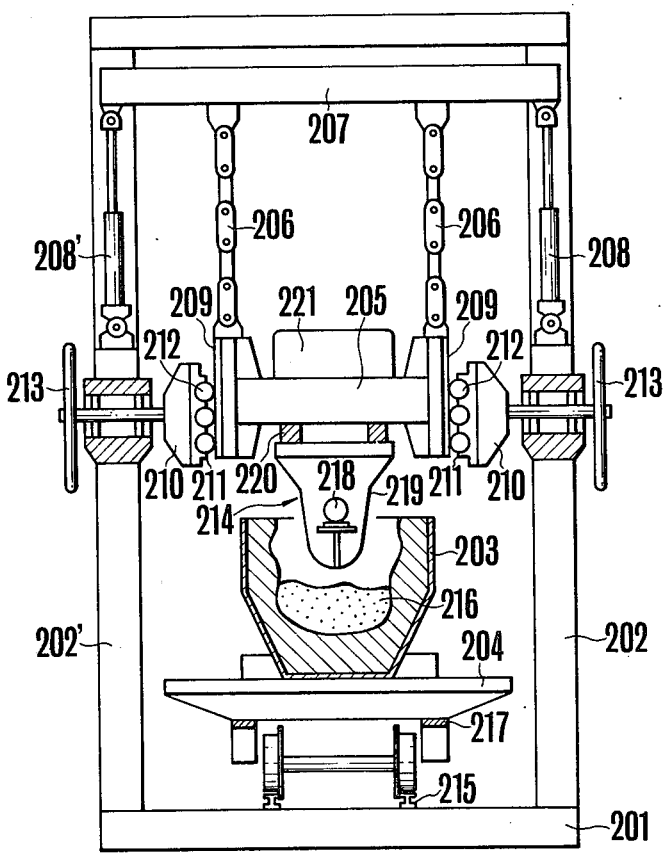

As shown in FIG. 10, four frame columns 202, 202′, 202″, 202‴ are provided standing up right on the base frame 201, and the columns 202 and 202′ are spaced so as to permit entrance therebetween of a car 204 carrying the trough 203. A supporting frame 205 is arranged between the columns 202 and 202′, and suspended by the chain 206 connected to the frame 207. The frame 207 is moved up and down by the cylinder mechanism 208, 208′ provided on the frame columns 202, 202′ and actuated by fluid pressure.

At both ends of the supporting frame 205, a supporting face 209 extending vertically is formed and held by the position adjustment member 210 provided on the columns 202 and 202′. The top end of the position adjustment member 210 is provided with a vertical supporting face 211 having a plurality of rollers 212. The rollers 212 may be arranged on the supporting plane 209 and the supporting face 211 may be an open plane.

The relation between the vertical length of the supporting face 209 and that of the supporting face 211 is such that the face 209 and the face 211 contact each other indirectly by means of the roller both at the lowest and highest positions of the supporting frame 205. The position adjustment member 210 is moved back and forth by the operation of the handle 213. Therefore, the supporting frame 205, held by the position adjustment member, can be adjusted in its position between the columns 202 and 202′. The mold 214 in this embodiment is substantially the same as the mold 5 shown in FIG. 2 and its explanations will be omitted.

Below the mold 214 arranged movably up and down, the trough 203 is taken in, carried on the car 204 running on rails 215, and is placed in position fixedly. The refractory 216 has already been charged in the trough 203 at this stage. 217 and 220 represent respectively an anti-vibration member.

Explanations will be made on the operation of the present embodiment.

First, the cylinder mechanism 208, 208′ is operated to move down the mold 214. When the mold 214 is placed close to the trough 203, the handle 213 is operated to effect alignment of the trough and the mold 214. Then the lifting action of the cylinder mechanism 208, 208′ is released to place the mold 214 on the refractory mix 216 in the trough. Under this state the chain 206 is in a losen state.

Next, when the vibrator 218 is actuated to transfer vibration to the refractory mix through the vibrating member (molding member) 219, the refractory 216 begins to fluidize just like a slurry, while the mold 214 sinks-down. At this time, as the supporting face 209 is supported by the rollers 212 on the supporting face 211, the supporting frame does not incline, so that the mold 214 does not incline or fall.

In the completion stage of the vibration-pressing forming, the chain 206 restricts the sink-down of the mold 214. When the mold 214 does not sink-down any further, the vibrator 218 stops, and then the fluid refractory mix 216 solidifies, and the cylinder mechanism 208, 208′ is actuated to lift up the supporting frame 205. After the mold 214 is lifted up enough, the car 204 is moved to transfer the trough 203 to the drying yard.

In the embodiment shown in FIG. 10, adjustment of the lifting and sink-down of the mold 214 is performed by means of the cylinder mechanism 208, 208′ and the chain 206.

Figure 11:
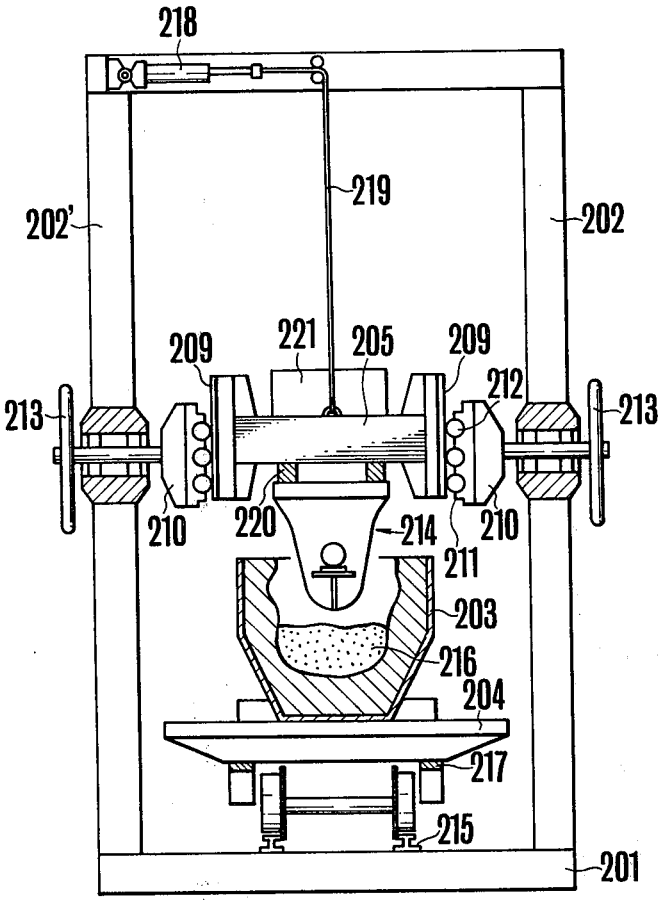

FIG. 11 shows a still another embodiment of the present invention, in which adjustment of the lifting and sink-down of the mold 214 is performed by means of the cylinder mechanism 218 and the wire 219. For taking-in and taking-out of the trough 203, the supporting frame 205 is lifted up by the cylinder mechanism 218, and at the time of the vibration-pressing forming, the lifting action of the cylinder mechanism 218 is released so as to allow the mold 214 to sink-down. Upon completion of the vibration-pressing forming, the cylinder mechanism 218 is actuated to restrict the sink-down of the mold by means of the wire 219. As for the stopper mechanism for the mold 214, the chain 206 as shown in FIG. 10 may be provided.

As described above, according to the present invention, the mold is placed on the powder and granular refractory charged in the container, and for the vibration-pressing forming, the supporting frame of the mold is supported by the guide means so that during the sink-down of the mold by gravity of the mold and the weight and during the sink-down due to the fluidization of refractory caused by its thixotropic property of the refractory, the mold is maintained stable in its posture, and uniform free sink-down of the mold can be attained.

Fluidization of the refractory due to its thixotropic property is developed uniformly by the uniform sink-down of the mold, and in turn the free sink-down of the mold is stablized thereby, and thus quick vibration-pressing forming can be attained.

Also, in the present invention, it is possible to select various types of the apparatus in correspondence to the nature of the container to be lined. For example, for a non-movable container such as a fixed trough, the movable mold is used with a guide means of simple structure, and for a movable container, such as an exchangeable trough and a tundish, a fixed apparatus is used. Therefore, the present invention is applicable to the lining of various types containers.

Further, according to the present invention, an anti-vibration member is provided between the mold and the supporting frame and transfer of the vibration from the mold to members which do not require vibration is prevented by the anti-vibration member so that a required amount of vibration can be given to the powder and granular refractory without causing abnormal vibration sound.

We claim:

1. In apparatus for forming a refractory lining for a container comprising a vibration-pressing mold to be placed on a refractory mix charged in the container, the outer shell of said mold being composed of a metal plate, a plurality of vibrators attached respectively to a vibration-transfer frame provided on the inside of said metal plate, an anti-vibration member provided on the upper end of said mold, a supporting frame for supporting said mold provided on said anti-vibration member, and a guide member for maintaining said mold in a stabilized posture during its sinking-down movement into said refractory mix, the improvement wherein said mold is portable and is placed on the refractory mix charged in the container to be lined, said mold is sinkable by its own weight, said supporting frame is extended beyond the width of the mold, a weight is placed on said supporting frame, a plurality of guide members extending essentially vertically to said supporting frame are provided so as to move up and down by means of a driving member attached thereto, and a changeable space is established between the lower sides of said guide members and the upper face of said container.

2. The improvement according to claim 1, wherein said guide members comprise supporting columns and wherein said driving member comprises screws.

3. The improvement according to claim 1, wherein said guide members comprise a plurality of cylinder mechanisms each including rods which are movable up and down when applied with fluid pressure, said cylinders being suspended by and fixed to the lower side of the supporting frame.

4. The improvement according to claim 1, wherein said guide members comprise a plurality of cylinder mechanisms having rods which are movable up and down when applied with fluid pressure and provided upright at the upper face of said container with a changeable space being established between the top ends of said rods and the lower side of said supporting frame.

5. Apparatus for forming a refractory lining in a metallurgical container comprising a metallurgical container, a refractory mix exhibiting thixotropic properties placed within said container for forming a lining for said container, a vibratory pressing mold for pressing into said mix including means for effecting vibration of said mold during said pressing, mounting means supporting said mold above said container over said mix and operating to drop said mold into said container to allow said mold to fall by force of gravity into said mix to form said mix into a liner for said container, and guidance means for maintaining said mold in a generally balanced condition during its fall into said mix, said guidance means comprising a plurality of adjustable stop members spaced peripherally about said mold and adjustable to divide said fall of said mold into a plurality of discrete stages, said stop means operating to bring said mold to a complete stop in a predetermined balanced position at the end of each of said stages of said fall of said mold into said mix, with adjustment of said stop members determining the length of each of said stages of said fall.

6. Apparatus according to claim 5, wherein said stop means comprise a plurality of screw members and abutment surfaces adapted to be engaged by said screw members to stop said fall of said mold, said screw members being threadedly adjustable to adjust the length of each of said stages of said fall.

7. Apparatus according to claim 6, wherein said screw members are threadedly engaged upon said mold and wherein said abutment surfaces are formed on said container.

8. Apparatus according to claim 5, wherein said stop means comprise a plurality of cylinder devices having rod means therein and adapted to vary the position of said rod means by application of fluid pressure to said cylinder devices, and abutment surfaces engaging said rod means to stop the fall of said mold into said mix, with the position of said rod means operating to determine the length of each of said stages of said fall.

9. Apparatus according to claim 8, wherein said cylinder means are mounted upon said mold and wherein said abutment surfaces are formed on said container.

10. Apparatus according to claim 8, wherein said cylinder devices are mounted upon said container and wherein said mold includes a supporting frame having said abutment surfaces formed thereon.

* * * * *